United States Patent [19]

Labombarde et al.

[11] Patent Number: 4,707,970

[45] Date of Patent: Nov. 24, 1987

[54] APPARATUS FOR PACKAGING BOX FLATS

[75] Inventors: Raymond A. Labombarde, Nashua; Robert A. Tremblay, Hollis, both of N.H.

[73] Assignee: International Paper Box Machine Co., Nashua, N.H.

[21] Appl. No.: 872,559

[22] Filed: Jun. 10, 1986

Related U.S. Application Data

[63] Continuation of Ser. No. 583,640, Feb. 27, 1984, abandoned.

[51] Int. Cl.[4] ..... B65B 63/02

[52] U.S. Cl. ..... 53/529; 53/542; 53/566; 53/247; 53/252

[58] Field of Search ..... 53/243, 390, 245, 391, 53/247, 392, 251, 436, 268, 529, 273, 535, 374, 564, 566, 542, 252; 100/218

[56] References Cited

U.S. PATENT DOCUMENTS

| | | | |
|---|---|---|---|
| 708,218 | 9/1902 | French | 53/245 |
| 2,956,381 | 10/1960 | Chauvin et al. | 53/247 X |
| 3,017,730 | 1/1962 | Rodish | 53/529 |
| 3,724,185 | 4/1973 | Berney | 53/566 |
| 3,811,549 | 5/1974 | Preisig | 53/542 X |
| 4,028,864 | 6/1977 | Bell | 53/529 X |
| 4,141,193 | 2/1979 | Joa | 53/542 X |
| 4,531,343 | 7/1985 | Wood | 53/542 X |

*Primary Examiner*—Robert L. Spruill

*Assistant Examiner*—Steven P. Weihrouch

*Attorney, Agent, or Firm*—Pearson & Pearson

[57] ABSTRACT

An apparatus and method by which a single operator, at a single station, can pack pre-counted slugs of flat folded cartons, or trays, in one or more layers, in corrugated cases for discharge to a case taper several times faster than with manual packing by several operators. The "flats" are advanced in a longitudinal path on a secondary apron of a stacker, erect on one edge, pre-counted and divided into slugs, so that the single operator can slide each slug longitudinally past a one-way back stop onto a transfer table. The slug may be turned on its longitudinal axis by the operator for inspection and then compressed longitudinally by a ram against the back stop. The operator has already been presented with a single, flat, tubular case, from a stack of such cases, with the leading flaps folded back, and has manually erected the case and inserted it in a case gripper preferably poised above the table, thereby closing the minor bottom closure flaps. A start button brings the case gripper down to the level of the transfer table so that the operator can push the compressed slug laterally into the open case, resting on its side wall in the case gripper. The case is automatically lowered to receive the next slug and when full, is turned on a longitudinal axis through 90° onto its bottom and discharged to a case taper while the case gripper returns to its original position above the level of the transfer table.

9 Claims, 5 Drawing Figures

APPARATUS FOR PACKAGING BOX FLATS

This is a continuation of my application Ser. No. 583,640 filed Feb. 27, 1984, now abandoned.

BACKGROUND OF THE INVENTION

The art of manufacturing flat, glued, folded paper boxes, termed "flats" herein has progressed to the extent that folding and gluing machines produce the same at such high speed that it becomes a problem for the packaging operators, at the end of the stacking aprons, to keep up with production.

The flats advance along the stacker apron, or conveyor, in shingled formation, with every 50th flat counted and kicked slightly laterally out of the longitudinal shingled formation, so that the packaging operators can visually note what is called herein a lift, of fifty flats, or some other desired number thereof, reach over the stacking apron and grip between both hands as many as constitute a convenient lift and carry successive lifts manually over into an empty carton, until a slug, or row, is achieved in the carton.

It will be apparent that a slug of one or more lifts of fifty flats is normally more than one operator can handle in one trip and is like an accordian in that if great compression pressure is not used, or if one part of each flat is extra thick to form a bulge, or if the operator, usually a woman, becomes tired or careless a slug can easily become deformed and the flats fall all over the floor. While picking up such flats, the stacker continues to feed shingled flats to the operator so that the need for a practical packaging apparatus, capable of handling entire slugs at a time, becomes apparent to assure against such mishaps and to match the speed of production.

It has been proposed in U.S. Pat. No. 3,943,681 to Preisig of Mar. 16, 1976 to position a plurality of stacked flats on a slideable closure, and over a container, and to then open the closure to drop the flats into the container.

It has also been proposed in U.S. Pat. No. 4,141,193 to Joa of Feb. 27, 1979 to advance a group of diapers along a path up to a back stop fixed at the end of the path, a compression ram being poised outside the path but moveable by power into the path to compress the diapers. The compressed diapers are then power rammed laterally into a funnel and thence into an empty carton lying on its side. There appears to be no space at the compression station for an operator to inspect quality.

There have been many proposed machines for automatically receiving filled packages and inserting such packages into cartons. However, such machines would not be acceptable in the folding paper box art because, despite the high speed production of a folding and gluing machine, it is considered essential that an operator have an opportunity to inspect each slug, or group, of glued flats, to turn the slug over and remove any defectively glued flats before permitting the slug to be packed in a shipping carton.

Applicant is aware of a tear sheet (copy submitted with this application) entitled "JAGENBERG" with heading in English "Simple Folding Box Packing Station EFA-1, suited for all folding box gluers, for higher outputs with only one operator at the "delivery end" believed to be of 1971 vintage. It is not known how this machine was intended to operate, or whether it reached the market, but the empty cases are right side up on an upper chain, out of reach of an operator. The slugs may move down around a curved path through an angle of 90° as in Jagenberg Patents to Klapp, U.S. Pat. No. 4,249,360 of 1981. The empty cases are already erected with the bottom flaps closed, while the empty cases, handled in this invention, are in flat, open tubular form to avoid use of excessive storage space.

SUMMARY OF THIS INVENTION

In this invention, the cartons, or trays, are delivered in flat, folded form, at high speed, by the conventional stacker apron of a folder-gluer onto a secondary apron traveling at a slower speed and are caused to advance thereon, erect on one edge, pre-counted, with the count visible by, for example, each fiftieth flat projecting laterally from the advancing stack.

The term "lift" is used herein to mean the number of flats an operator can lift between her hands and repeatedly carry from a stacker apron over to an empty packing case without undue exhaustion and physical strain during a day's work. The term "slug" is used herein to mean the number of such flats which fills an entire row in an empty packing case, and such a "slug" is normally too heavy, clumsy, and elongated for an operator to lift and carry between her hands.

The number of flats in a "lift" or "slug" varies with the stock, area, and weight of the type of flats being run.

In this invention, the slugs are handled as units, without separation into carryable lifts, and are always supported on a surface while slid therealong or even when being turned for inspection.

A slug transfer table is provided, in the longitudinal path of the advancing flats, at the end of the secondary apron, so that the operator can grasp the leading slug, slide the slug past a backstop onto the transfer table and either release it, to be held between the compressor ram and the rear gate backstop, or, if necessary, turn it 90° for inspection of adhesion and folding.

Upon the operator releasing the slug to the compressor ram on the far side and the backstop on the near side, she actuates the powered ram to compress the slug against the backstop.

A case presenter, within easy reach of the operator, presents flat, folded, tubular, corrugated cases, with the leading closure flaps folded back, individually and successively, to the operator, who grips the endmost case by the corners, erects it into an open tube and inserts it into the case gripper of a case turner unit. The case gripper is preferably poised at a level above the level of the transfer table and includes a support tongue for forming a temporary barrier closing the bottom minor flaps of the case and includes guides for holding the top minor flaps open with the case on its side and its opening facing the operator.

A start button pressed by the operator brings the case gripper and its case down to the level of the transfer table so that the operator can actuate a push bar to push the compressed, and inspected, lift into the case.

If another layer of flats is to be inserted in the case, the case turner unit automatically brings the case gripper down to a second level for receiving a second layer. It then automatically turns the filled case back to rest on its bottom, closes the bottom major flaps, closes the minor top flaps, and ejects the case to a bottom and top taping machine.

The parts all then resume their original position for the next cycle with the case gripper returning to its location above the transfer table ready to receive the next case.

By the apparatus and method of the invention, a single operator has ample time to keep up with the discharge rate of a modern folder-gluer and is easily able to grip and erect a flat case and insert it in the case gripper, then grasp a pre-counted lift of flats, slide it onto the transfer table, turn it for inspection, compress it, and push the compressed lift into the case in the case gripper, and repeat the operation while the next lift is advancing the length of a lift.

DESCRIPTION OF A PREFERRED EMBODIMENT

Figure 5:
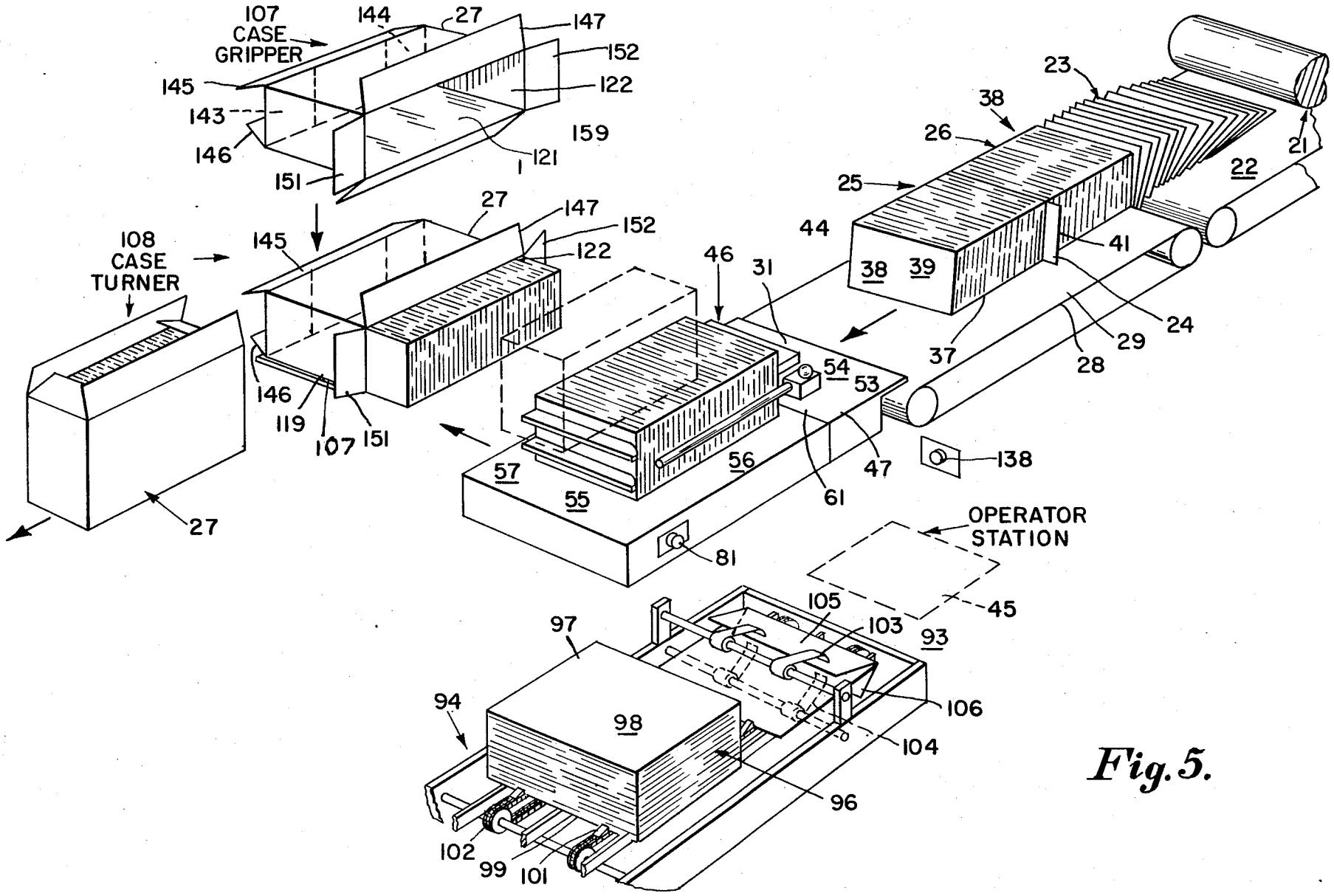
FIG. 5 is a diagrammatic representation of the steps of the method of operation by a single operator in inspecting, compressing and inserting pre-counted slugs of flats, individually and successively, into empty corrugated cases for subsequent taping of top and bottom closure flaps of the cases.

A conventional stacker 21 is shown fragmentarily in FIG. 5 of the drawings, the stacker having a stacker apron 22 upon which the flats 23 are advanced in shingled formation, having been folded and glued at high speed on a folder-gluer, not shown, but of well known type. Suitable, well known counting mechanism automatically kicks out every fiftieth flat, such as shown at 24, so that the individual, successive slugs 25, and 26, are segmented, and visually separated, into pre-counted groups capable of being grasped between the hands of the single operator and usually of such length that, when compressed, the slugs will each fit in a corrugated case 27.

A secondary stacker apron 28 is provided, in continuation of apron 22, but having an upper stretch 29 advancing along the longitudinal path 31 at a speed lower than the speed of apron 22, both aprons being driven by a suitable power train connection to the folder-gluer, not shown. A hold down belt 32, (FIG. 4) having a lower stretch 33 advancing in the direction of advance of the flats 23, and a hold down roller 34, are provided above the end roll 35 of the primary apron 22 to assist in raising the advancing flats from shingled formation to upstanding, edge-supported, formations as shown at 36 in FIGS. 4 and 5.

The individual and successive slugs 25 and 26 advance in substantially upright position, supported on secondary apron 28 and resting on their lower edges such as 37, the leading flat 38 leaning slightly rearwardly. Thus, as each close packed slug, such as 25, approaches the operator station 45, the operator can place her left hand on the exposed face 39 of leading flat 38 and her right hand on the rear face 41 of the projecting, fiftieth flat, 24, and slide the segregated slug forwardly past the backstop means 46 onto the transfer table 47 of the slug inspection and compression means 48.

Means 48 includes the substantially horizontal transfer table 47, in longitudinal extension of, and at substantially the same level as, the upper stretch 29 of secondary stacker apron 28. Table 47 is vertically movable by the scissors type levers 49 and 51 on base 52, so that the table, or platform 47, is substantially at the same level as the level of upper stretch 29 of secondary apron 28 and in longitudinal extension of the path 31. Table 47 may be a hydraulically actuated lift table such as manufactured by Southworth Machine Company of South Portland, Me.

The table or platform 47, is substantially horizontal and includes a backstop end 54, proximate stacker apron stretch 29, an opposite compressor ram end 55, a pusher bar side 56, at the side of the operator station 45 and an opposite slug discharge side 57.

The one-way backstop means 46 is provided at the backstop end 54 of transfer table 53, in the form of upper, laterally extending one-way cantilevered element 59 and lower, laterally extending, one-way element 61, both transverse to the longitudinal path 31 of the slugs 25 or 26, but spaced apart by a space 62 sufficient to pass each slug as slid therethrough in the hands of the operator.

The upper laterally, extending, one-way cantilevered element 59 can be a rod 63 only, the operator merely tilting the slug rearwardly to pass it through the space 62 and then shifting the flats to vertical to be compressed against the rod 63.

The upper one-way backstop element 59 can also be a gate, pivotally mounted from a rod 63, cantilevered above the path 31 and vertically adjustable relative to an upright post 64, there being a stop so that it will swing in the direction of movement of the slug from the stacker apron onto the transfer table, but will not swing rearwardly when the slug is compressed thereagainst.

However, it is preferred that the upper, one-way backstop element 59 comprise a row of leaf springs, such as 65, each extending downwardly, at a slight angle, from the cantilevered rod 63 and each having a roller 66 at its free terminal end, so that the slug will raise the springs 65 and rollers 66, in being passed thereunder, but the springs and rollers then spring downwardly behind each trailing flat in the slug to serve as the upper backstop element 59 during compression of the slug.

The lower backstop element 61 preferably is a shoulder 67 extending across the path 31, directly below the row of rollers 66 of the cantilevered upper element 59, so that each successive individual slug 25, or 26, slid through the space 62, drops behind the shoulder 67 to enable it to form an immovable, one-way, lower backstop against compression. The post 64 is on the lift discharge side 57 of transfer table 47 in order not to interfere with the sliding of the pre-counted slugs through the space 62 onto the table 57, ready for inspection, assembly, and compression.

The rod 63 is vertically adjustable on post 64 to conform to the height of the lifts 25 or 26 by screw 68 and hand wheel 69 on post 64.

Figure 1:
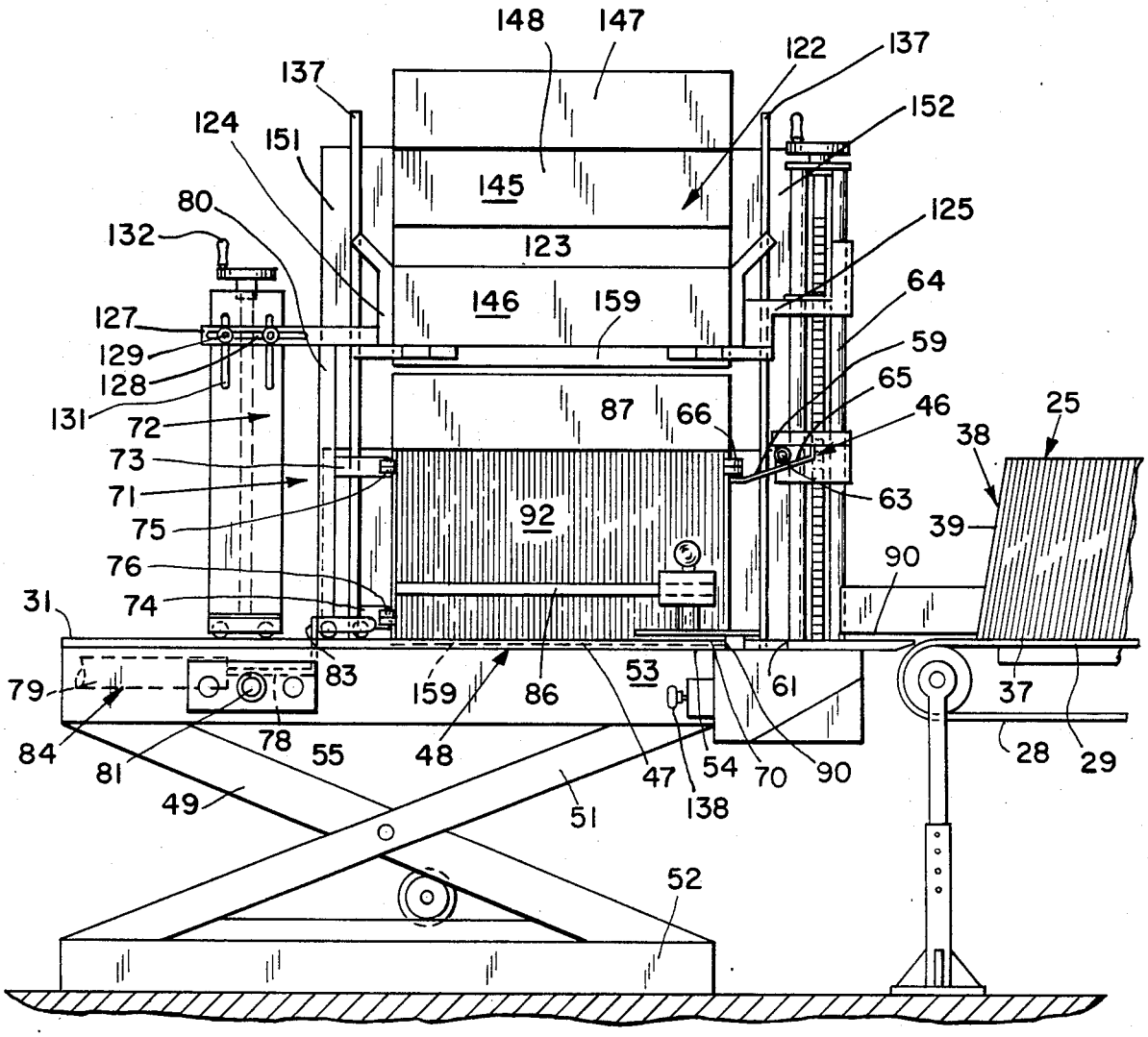
FIG. 1 is a front elevation of the transfer table and case gripper of the invention as viewed from the station of the single operator.

Compressor ram means 71 is provided at the compressor ram end 55 of the transfer table 47, and includes a compression head 72 having at least one, and preferably two, spaced apart laterally extending, compressor rams 73 and 74 each with a row 75, or 76, of freely revoluble rollers, such as 77, to reduce friction during push bar discharge of the compressed slugs, (FIG. 1). The compressor rams 73 and 74 are normally retracted, but are movable along the longitudinal path 31 toward the back-stop means 46 by pneumatic piston 78 and cylinder 79, to compress each individual and successive slug 25 or 26 when the operator presses a switch 81. A longitudinal slot 82 in transfer table 47 accommodates the connection 83 between the tip of piston 78 and the compression frame 80. Compression head 72 is clamped in place on table 47 by clamp knob 132 to adjust to the length dimension of the cases 27. While all of the power for the apparatus of the invention is preferably hydraulic, the compressor ram power mechanism 84 is pneumatic, so as to be yieldable in case the hands of the operator are inadvertently caught therein. The source of air pressure is a suitable air pump and tank, or mill air, not shown.

Figure 3:
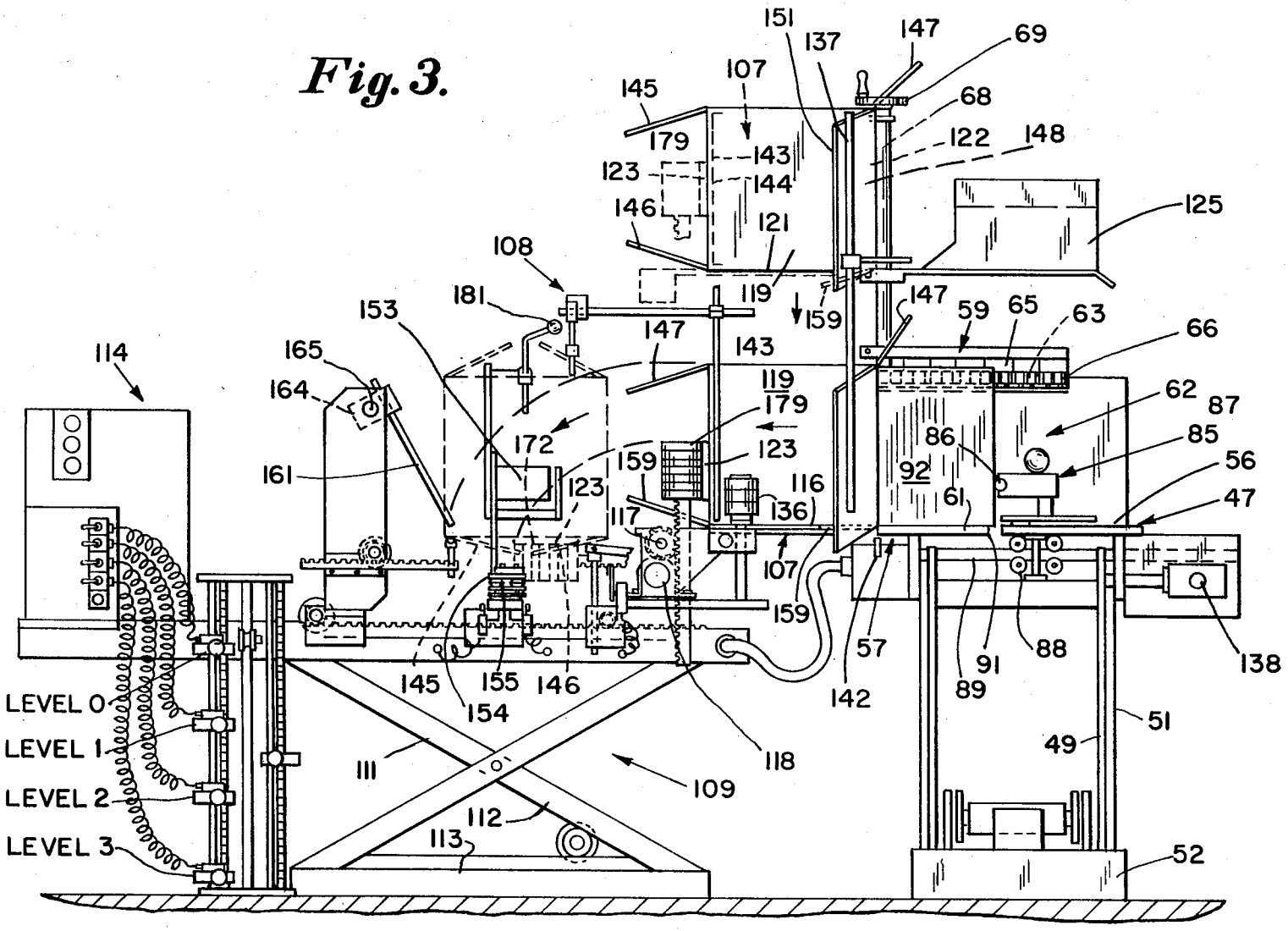
FIG. 3 is a side elevation of the case packer of the invention from the filled case discharge side.

Push bar means 85 is provided at the push bar side 56 of transfer table 47, adjacent the operator station 45 and consisting of a longitudinally extending bar 86, having a knob 87, and mounted on a wheeled carriage 88, movable laterally of path 31 on a track 89 in a slot 91 in table 47 (FIG. 3). Slot 91 is formed by a space between the plate 90, forming the shoulder 67 and the underlying surface 70 of transfer table 47.

Thus, the single operator at station 45 can slide each slug, 25 or 26, through the space 62, of the one-way backstop means 46 onto the slug compression and inspection table 47, turn the slug on its longitudinal axis 90° to inspect the folds and adhesion of the flaps and tabs, turn it back through 90°, if desired, press the compressor ram button 81 to compress the slug against the backstops 59 and 61, and push the compressed slug 92 laterally across the table 47 and off the discharge side 57.

Unlike prior art devices in which corrugated cases are provided in erected condition with bottom flaps closed, adhered and taped, to receive the slugs of flats, such cases occupying considerable floor space and usually requiring a second operator on the discharge side of the apparatus, in this invention the corrugated cases are stacked in flat tubular condition, near the operator station 45 as at 93, at case presentation station 94.

Case presentation means 95, at case presentation station 94, includes a magazine 96 holding a stack 97 of flat, tubular, corrugated cases 98, the magazine being of the bottom feed type with a gateway 99 for passing one flat case at a time and each successive lower most individual flat case being advanced through gateway 99 by lugs 101 on a feed chain 102, powered by a suitable motor and arranged to advance another case to easy reach of the operator, each time the lower most case is extracted. Suitable back fold hooks 103 and 104 fold back the leading flaps 105 and 106 of each case, as it advances to presentation position, so that the operator can grasp the opposite corners, erect the case into an open tube and insert it into the case gripper 107.

Case turning means 108 is located on the slug discharge side 57 of the slug transfer and compression table 47 and includes the case gripper 107, which is normally at a level above the level of the surface 70 of the table 47. Means 108 is mounted on an hydraulically actuated vertically movable, table 109 having scissors type levers 111 and 112 on a base 113 and being movable from level 0, through level 1, and level 2 to level 3 by the control mechanism 114 as required by the run of flats, and cases.

Case gripper 107 includes a right hand turning fork 115, and a left hand turning fork 116, each having one end such as 117 mounted to pivot with a shaft 118 through an angle of 90° (FIG. 3), the forks 115 and 116 being normally horizontal to support an empty case 119 resting on its side wall 121 with its top opening 122 facing the operator at station 45 and facing transfer table 47. Case gripper 107 also includes the support tongue, or backer plate, 123 which is mounted about mid-height of the case 119 to close the minor, bottom end flaps of the case, as it is inserted, as an open tube, into the case gripper and to serve as a backer when the compressed slug is pushed into the case.

A left hand case side hopper 124 is adjustably mounted on compression head 72 and a right hand case side hopper 125 is adjustably mounted on upright post 64. Each case side hopper includes a pair of arms 126 and 127 having slots such as 128 for bolts such as 129 tightenable in vertical slots such as 131.

It will be seen that with the case gripper 107 positioned in its normal position at a level above the level of the transfer table, and directly in rear of the side hoppers 124 and 125, the operator in a single motion can withdraw a flat tubular case by the corners from the case presenter means 95, erect the case into an open tube, push it into the side hoppers and into the case gripper 107, the backer plate closing the minor bottom flaps of the case and the upper minor end flaps being held back, out of the way, by rods such as 137.

When the operator presses the sequence start button 138, the case gripper 107 is automatically lowered to the level of surface 70 of table 47, the first load position, with an empty case 119 ready to slidably receive a compressed slug such as 92. Preferably an alignment bar 139 is at this time in raised position along the discharge side 57 of table 47 so that the push bar can align the flats in the slug against the bar 139, whereupon it automatically moves out of the path down into a slot 141 so that the slug may enter the empty case.

As best shown in FIG. 3, the sequence control mechanism 114 has four levels, to which it automatically moves the case gripper 107 from its normal level 0, poised above the transfer table to receive an empty case 119, down to level 1, where the side wall 121 is flush horizontally with surface 70 of transfer table 47. If the case 119 is of a predetermined width sufficient to contain two or more slugs, such as 24 or 25, the control mechanism automatically moves the case gripper 107 down to level 2, as soon as the first compressed slug is inserted by the push bar 86, so that the upper edges of the inserted slug are flush horizontally with surface 70 of table 47.

A limit switch 142, at the end of the path of the carriage 88 of the push bar 86 signals the control mechanism 114 to lower the case gripper 107 to level 2 or to level 3, if three layers are desired in one case 119.

On the other hand, if only one layer, row, or slug of flats is to be inserted in each individual and successive corrugated case 119, the limit switch 142 signals control mechanism 114 to turn the now filled case 119 through an angle of 90° back onto its bottom flaps, and resting on support tongue 123 (FIG. 3).

At this point in the cycle the minor bottom flaps 143 and 144 of the case are already infolded, the case is supported on the elongated support tongue 123 and the major bottom flaps 145 and 146 are depending downwardly on each side of tongue 123.

The top major flap 147 at opening 122 is sufficiently stiff to remain up and out of the way of insertion of a compressed slug 92 into the interior 148 of an empty case 119, as shown in FIG. 3. The bottom major flap 159, at the opening 122, is folded under the empty case 119. The minor top flaps 151 and 152 at the opening 122, are held back by the rods 137.

A pair of gripper rolls 135 and 136, each on an opposite side of case gripper 107, and each rotatable on vertical axis, cooperate with support tongue 123 in maintaining each empty case 119, erect and fully open while the case is being filled. The gripper rolls remain in position, while rotatably contacting the side walls of a filled case, as the support tongue 123, the left hand turning fork 115 and right hand turning fork 116 turn the filled case back to rest on its bottom ready for discharge.

As soon as the final slug has been pushed into the empty case, and the case turner means 108 has rotated the filled case 119 through an angle of 90° onto its bottom it is discharged from the case turning unit along the support tongue 123 by the case pusher 153 which extends upwardly from a wheeled carriage 154, riding in tracks 155 and actuated by a chain 156. Chain 156 has a limit switch 157 and 158, each at an opposite end of its path to cause it to move the carriage, case pusher, and filled case, into a box taper 183, not shown, for taping of the top and bottom flaps.

As each filled case 119 is moved along the support tongue 123, the rear bottom flap folder rods 161, 162, and 163, affixed by clamp blocks such as 164, to a rod 165, upfold the rear major bottom flap 145. The folding of the rear bottom flaps 145, against the underface 172 of the support tongue 123, is completed by the lateral advance of the rear flap closer bar 166 carried by gear racks 167 slidable in tracks 168 and meshed with spur gear 169 on driven, shaft 171.

The front major bottom flap 146 is upfolded against the other side of the under face 172 of the support tongue 123, by the deflectors 173 and by the lateral advance of the front flap closer bar 174 carried by gear racks 175, slidable in tracks 176, and meshed with spur gears 177 on driven shaft 178.

The presser roll 179 cooperates with the underface 172 of support tongue 123 in holding the lower major bottom flaps 145 and 146 closed as the case 119 is advanced along the tongue 123.

A top rear flap closer 181 extends in advance of the case pusher 153 to engage the top minor rear flap 152 first and downfold it before the filled case is engaged by the pusher 153. An elongated top front minor flap closer 182 extends along the path of the case being moved by the case pusher 153 to down fold flap 151 as the case advances toward the box taper. The rear flap closer 181 advances with the case pusher 153 to hold down rear flap 152 until it passes under flap closer 182, whereupon the box taper, 183 which is of well known, commercially available, construction, closes over the top major flaps and applies adhesive tape along the top and bottom central seams of the filled case 119 in the usual manner.

All of the above operations are controlled and sequenced by the control mechanism 114.

Figure 2:
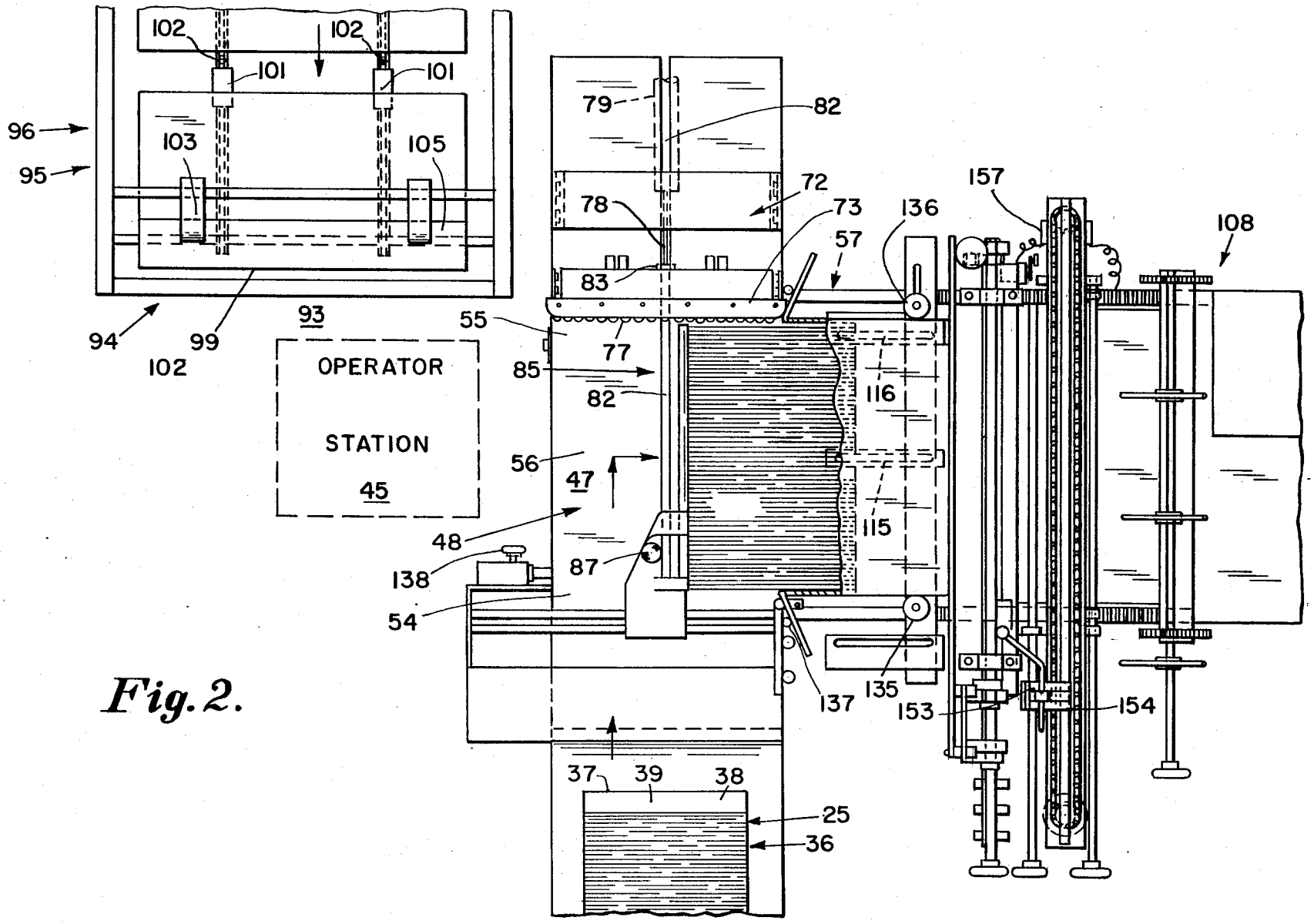
FIG. 2 is a top plan view of the case packer of the invention with parts removed for clarity.
Figure 4:
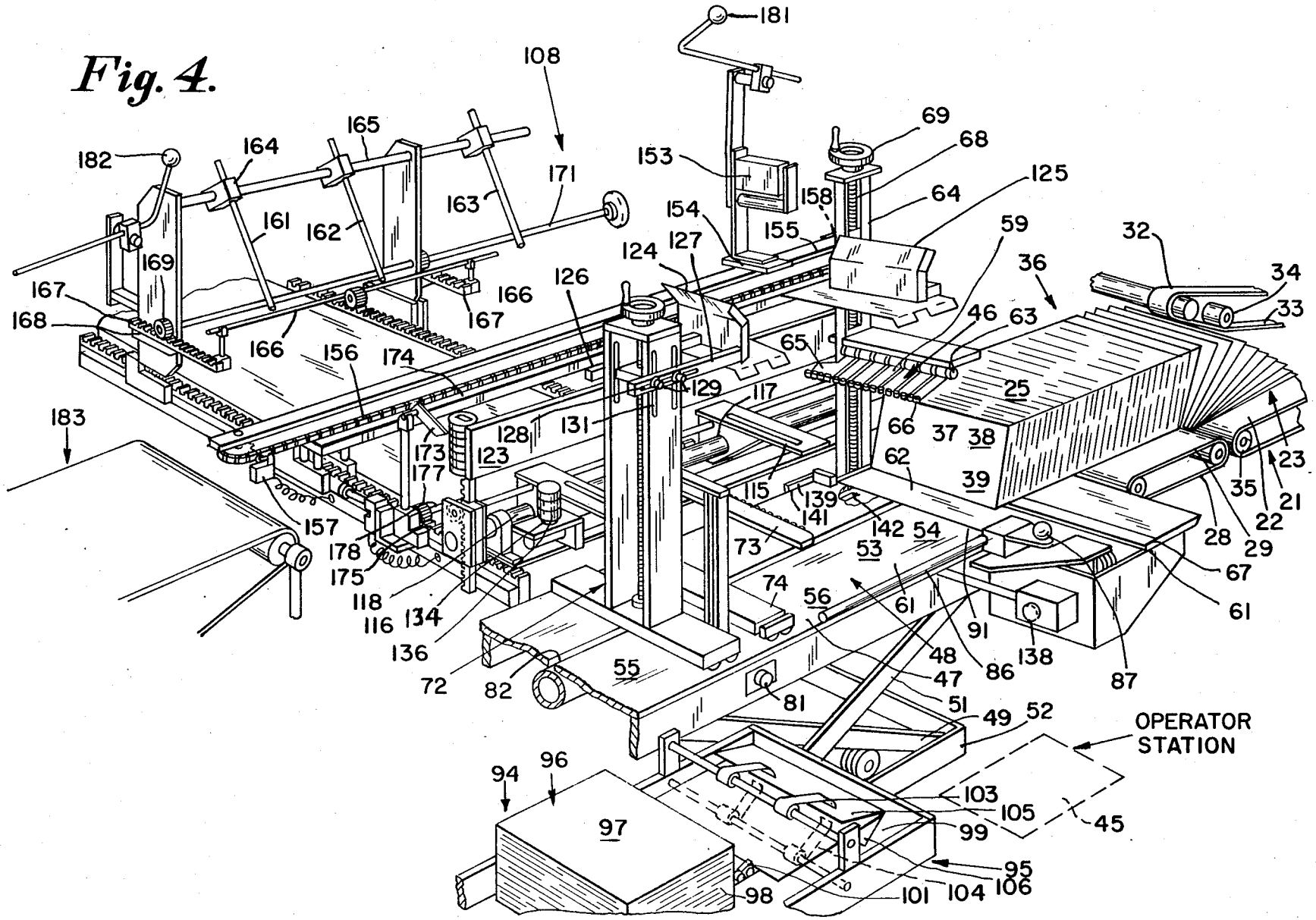
FIG. 4 is a perspective view of the case packer of the invention as seen from the left of the operator station.

The case gripper rolls 135 and 136 shown in FIGS. 2, 3, and 4 are rubber covered and each is provided with a one-way clutch such as indicated at 134. Thus, the operator can easily push the case into the grip of the rolls, with the clutch allowing rotation in the direction of advance without damage to the case, and once seated in the case gripper the case cannot bounce back toward the operator. Similarly, the case turning forks 115 and 116 can turn the filled case back onto its bottom by overpowering the soft, resilient tension of the gripper rolls 135 and 136, together with the cooperation of the one-way clutches during the compound motion of the case in its rearward curved path.

In its most simplified form the apparatus of the invention may consist only of the transfer table with one-way backstop, or gate, means 46 at one end and an upstanding support at the other end, the case gripper being located at the loading level of the transfer table. Thus, the operator would grasp each successive individual slug between the hands, slide it past the one-way gate onto the transfer table, turn it for inspection if necessary, manually compress it and slide it into the case gripper. The pivoted forks and support tongue would then turn through 90° to rest the filled case on its bottom ready for discharge to the taper. However, powered compression and automatic vertical movement of the case gripper is much preferred.

We claim:

1. Apparatus for individually and successively filling a plurality of empty cases with pre-counted slugs of flats advancing along a longitudinal path, by means of a single operator at a single station proximate the delivery end of the stacker apron of a folder-gluer said apparatus comprising:

case presentation means at said station, within reach of said operator, for individually and successively presenting flat, tubular cases, with the leading flaps folded back, for withdrawal and erection into open tubular cases by said operator;

slug inspection means at said station, including a slug inspection and compression transfer table, in extension of said stacker apron, for supporting each successive, pre-counted, slug slid thereon further along said longitudinal path from said stacker apron by said operator, for enabling each slug to be turned on its longitudinal axis through an angle of 90° for examination of its adhered glue flaps and tabs, said table having a one-way backstop means at the near end adjacent said apron, a compression ram at the far end opposite said backstop, a push bar at the side adjacent said station and a discharge side at the side opposite said station;

case turning means, on the discharge side of said table including case gripper means comprising a pair of turning forks and a pair of rubber covered gripper rolls for holding the case onto the turning means, each having a one-way clutch said forks and rolls being normally positioned at loading level relative to the level of said table for receiving and gripping an open tubular case, on its side, with top flaps folded back and closed minor bottom flaps, when slidably inserted therein by said operator;

and sequence control mechanism, including a power mechanism, actuated by said operator, for turning said turning forks of said case gripper means rearwardly through an angle of 90° to rest the case therein on its bottom, on a discharge conveyor and then to return said turning forks of said gripper means to said normal position.

2. Apparatus as specified in claim 1 wherein:

said one-way backstop means includes an upper, laterally extending, one-way, backstop and a lower laterally extending one-way backstop, said upper backstop being cantilevered from the discharge side of said table to form a space between said backstops in which the hands of the operator can freely move while grasping and sliding a counted slug of flats therebetween.

3. Apparatus as specified in claim 1 wherein:

said one-way backstop means and said compressor ram means each include spaced apart, laterally extending, elements for engaging the forward and rearward end of each slug at vertically spaced areas and at least some of said elements include sets of freely revoluble rollers for reducing friction during push bar discharge of each slug from said table.

4. Apparatus as specified in claim 1 wherein:

said transfer table is a hydraulically actuated, vertically movable table to accommodate itself to the height of various stackers:

said case turning means is also mounted on an hydraulically actuated, vertically movable table, to accommodate itself to the height of the transfer table;

but said ram power mechanism is pneumatically actuated and includes pressure control mechanism to yield in the event of inadvertent compression contact with the hands of an operator.

5. Apparatus as specified in claim 1 wherein:

said case gripper means includes a pair of rubber covered gripper rolls, each rotatable on a vertical axis on one of the opposite sides of said case turning means, and each having a one-way clutch permitting said rolls to rotate with a case being advanced thereinto, but preventing said rolls from rotating with a case when a case in said gripper means is subjected to retractive pressures toward said transfer table.

6. Apparatus for individually and successively filling a plurality of empty cases with pre-counted, compressed slugs of flats advancing along a longitudinal path by means of a single operator at a single station, located at the delivery end of a stacker apron of a folder-gluer said apparatus comprising:

slug inspection and compression means at said station, including a slug inspection and compression transfer table in longitudinal extension of said stacker apron, and at the level of said apron for supporting each successive, pre-counted slug slid thereon from said apron by said operator, one-way back stop means proximate said stacker apron, compression ram means at the far end of said table opposite said stacker apron for compressing said slug against said oneway back stop means, a slug discharge side and push bar means for pushing the compressed slug laterally across said table and off said discharge side;

case turning means, on the slug discharge side of said table, said means including case gripper means, having a case gripper, sometimes poised at a level above the level of said inspection and compression transfer table but vertically movable down to a loading position at the level of said table for slidably receiving an erected open tubular case inserted therein by said operator, said apparatus closing the minor bottom flaps thereof;

said case gripper including a pair of pivotable forks for supporting an empty case on its side wall, a support tongue for holding the minor flaps closed, and a pair of one-way, rotatable gripper rolls each engaging one of the opposite sides of said empty case and said case gripper means including a pair of fixed side guides for receiving an erected case; and sequence control mechanism, including power mechanism, moving said case gripper vertically, and for turning said pivotable forks, support tongue and case rearwardly to rest said case on its bottom flaps for discharge by discharge means and return thereof to said normal loading level position.

7. Apparatus operable by a single operator from a single location at one side of said apparatus for individually and successively packing a plurality of counted slugs of flat folded cartons, being delivered at high speed in shingled formation along a longitudinal path on a stacker apron, into packing case, said apparatus comprising:

an elongated slug inspection and compression table in extension of said stacker apron;

case gripper support means for supporting one case of a plurality of identical, erected, empty, packing cases, individually and successively at the side of said table opposite to said one side of said apparatus, each said case with its top opening facing toward said operator until filled and then moving said filled case away from said table;

slug inspection and compression means including a one-way backstop means, at one end of said table, proximte said stacker apron, and in the path of said slugs for one-way passage of each individual and successive counted slug forwardly therethrough from said stacker apron onto said table and forming a backstop against rearward movement thereof, to enable said slug to be turned 90° for inspection on said table and compressor ram means at the other end or far side of said table, including a compressor ram normally retracted and at the level of the path of said slugs to engage the leading end of each slug and power mechanism for moving said ram toward said backstop means to compress said slug therebetween after said inspection and a manually operated switch for actuating said mechanism; and manually operable push bar means, slidable across said table from said one side of said apparatus to the said other side to push each compressed slug laterally into the open case halted at said other side, said means including a limit switch reactuating said case gripper support means to move said filled case away from said table.

8. Apparatus operable by a single operator from a single location at one side of a slug compression and inspection table, for individually and successively packing a plurality of counted slugs of flat, folded cartons, being delivered at high speed along a longitudinal path in shingled formation on a stacker apron, into packing cases, said apparatus comprising:

means for supplying a plurality of counted, compressed, slugs of said flats individually and successively onto said table, compressing each slug, and pushing each slug individually and successively laterally off the other side of said table opposite to the said one side;

case turning means, on the said other side of said table, said means including case gripper means, sometimes poised at a level above the level of said table, for slidably receiving an erected, open, tubular case inserted therein by said operator, the case resting on a side wall with its top opening facing said operator, its bottom minor flaps held closed by a support tongue and its said side wall resting on pivotable turning forks;

and sequence control mechanism including power mechanism actuated by a start button within reach of said operator, for lowering said case gripper to the level of said table for slidably receiving a compressed, inspected counted slug of said flats pushed laterally across said table, then pivoting said turning forks through an angle of about 90° to rest the case on said support tongue, then upfolding the bottom major flaps against the under face of said tongue and down folding the minor top flaps of each case while pushing the case along the tongue in the direction of discharge to a box taper.

9. Apparatus as specified in claim 8 wherein:

said sequence control mechanism includes a plurality of folder rods, attached by clamp blocks to a common support rod, said rods being located in the path of the rear bottom major flap of each case as it is moved through an angle of 90° by said pivotable turning forks to urge said flap into upfolded position under said support tongue.

* * * * *